US006129565A

United States Patent [19]

Lai

[11] Patent Number: 6,129,565

[45] Date of Patent: Oct. 10, 2000

[54] CABLE CONNECTOR HAVING A GROUNDING DEVICE

[75] Inventor: Chin-Te Lai, Tao-Yuan, Taiwan

[73] Assignee: Hon Hai Precision Ind. Co., Ltd., Taipei Hsien, Taiwan

[21] Appl. No.: 09/448,093

[22] Filed: Nov. 23, 1999

[30] Foreign Application Priority Data

Aug. 24, 1999 [TW] Taiwan ..... 88214394

[51] Int. Cl.[7] ..... H01R 4/66

[52] U.S. Cl. ..... 439/101; 439/884; 439/610; 439/98; 439/489

[58] Field of Search ..... 439/579, 610, 439/108, 101, 884, 886, 889, 866, 98, 99, 489

[56] References Cited

U.S. PATENT DOCUMENTS 5,207,603 5/1993 Peloza ..... 439/884
5,716,236 2/1998 O'Sullivan et al. ..... 439/610
5,795,197 8/1998 Tsuji et al. ..... 439/884

*Primary Examiner*—Paula Bradley
*Assistant Examiner*—Tho D. Ta
*Attorney, Agent, or Firm*—Wei Te Chung

[57] ABSTRACT

A cable connector of the present invention includes a grounding device which comprises a grounding plate and a terminal module. The grounding plate is arranged in a symmetrical dual-layer configuration, being made from a sheet of metal symmetrically stamped and bended and then folded double. A clamping portion is formed at one end of the grounding plate. The clamping portion includes clamping sections used for retaining cables. A mating portion is defined at a second end of the grounding plate opposite the clamping portion for engaging with a mating connector. A locking portion is defined in a middle of the grounding plate proximate the mating portion and includes at least a spring locking member adapted to securely engage with the terminal module, which connects the grounding plate to the cable connector. A bulge is disposed on the mating portion of the grounding plate providing a mechanism for a user to sense positive engagement and disengagement between the cable connector and a mating connector.

5 Claims, 5 Drawing Sheets

CABLE CONNECTOR HAVING A GROUNDING DEVICE

BACKGROUND OF THE INVENTION

The present invention relates to a cable connector having a grounding device, and particularly to a cable connector having a grounding device providing a detection mechanism assuring effective engagement between the cable connector and a mating connector when the cable connector mates with the mating connector.

Cable connectors generally have grounding devices for electrostatic discharge, as disclosed in Taiwan patent application Nos. 86102087, 86102088, 86102094 and 86102095. As shown in FIG. 4, a conventional cable connector disclosed in U.S. patent application No. 5768771 comprises a dielectric housing 50, a front shell 51, a cover shell 52 and a grounding blade 7. A terminal module 40 is mounted within the dielectric housing 50, the terminal module 40 includes a pair of terminal blocks 40*a* and 40*b* which clamp the grounding blade 7 therebetween. Each cable 6 of the terminal module 40 comprises a plurality of center conductors 60 each enclosed by a metal shield 600. Referring to FIG. 5, clamping arms 70 are formed at one end of the grounding blade 7 for retaining the cable 6, while an engaging portion 72 at another end of the grounding blade 7 makes electrical connection with a mating connector. A recess 71 is defined in a clamping portion for engaging with a tag 500 disposed in the terminal block 40*a* to securely retain the terminal blocks 40*a* and 40*b* to the grounding blade 7. However, the grounding blade 7 is planer and includes no mechanism helping a user to sense positive engagement between the cable connector and a mating connector. Although some measures are taken to overcome this defect, such as providing protuberant traces and hollow traces in the engaging portion, these methods are limited by the single-layer configuration of the grounding blade. Hence, an improved cable connector having a grounding device is required to overcome the disadvantages of the prior art.

BRIEF SUMMARY OF THE INVENTION

An object of the present invention is to provide a cable connector having a grounding device which provides a reliable mechanism allowing a user to sense positive engagement between the cable connector and a mating connector when the cable connector mates with the mating connector.

A cable connector of the present invention includes a grounding plate arranged in a symmetrical dual-layer configuration, a clamping portion being formed at a rear end thereof, the clamping portion including clamping sections for retaining a cable. A mating portion is defined at a front end of the grounding plate for engaging with a mating connector. A locking portion is defined in a middle of the grounding plate proximate the mating portion, thereon including at least a spring locking member and a pair of tabs.

According to the present invention, the inclined locking members are stamped on opposite surfaces of the locking portion and engage with a front side of an insulative terminal module, which forms the attachment between the grounding plate and the cable connector. A plurality of tabs project from opposite sides of the locking portion proximate the clamping portion for abutting a rear side of the terminal module. A bulge is disposed on the mating portion of the grounding plate for allowing a user to sense positive engagement and disengagement between the cable connector and a mating connector when the cable mates with the mating connector.

Other objects, advantages and novel features of the invention will become more apparent from the following detailed description of the present embodiment when taken in conjunction with the accompanying drawings.

DETAILED DESCRIPTION OF THE INVENTION

Figure 1:
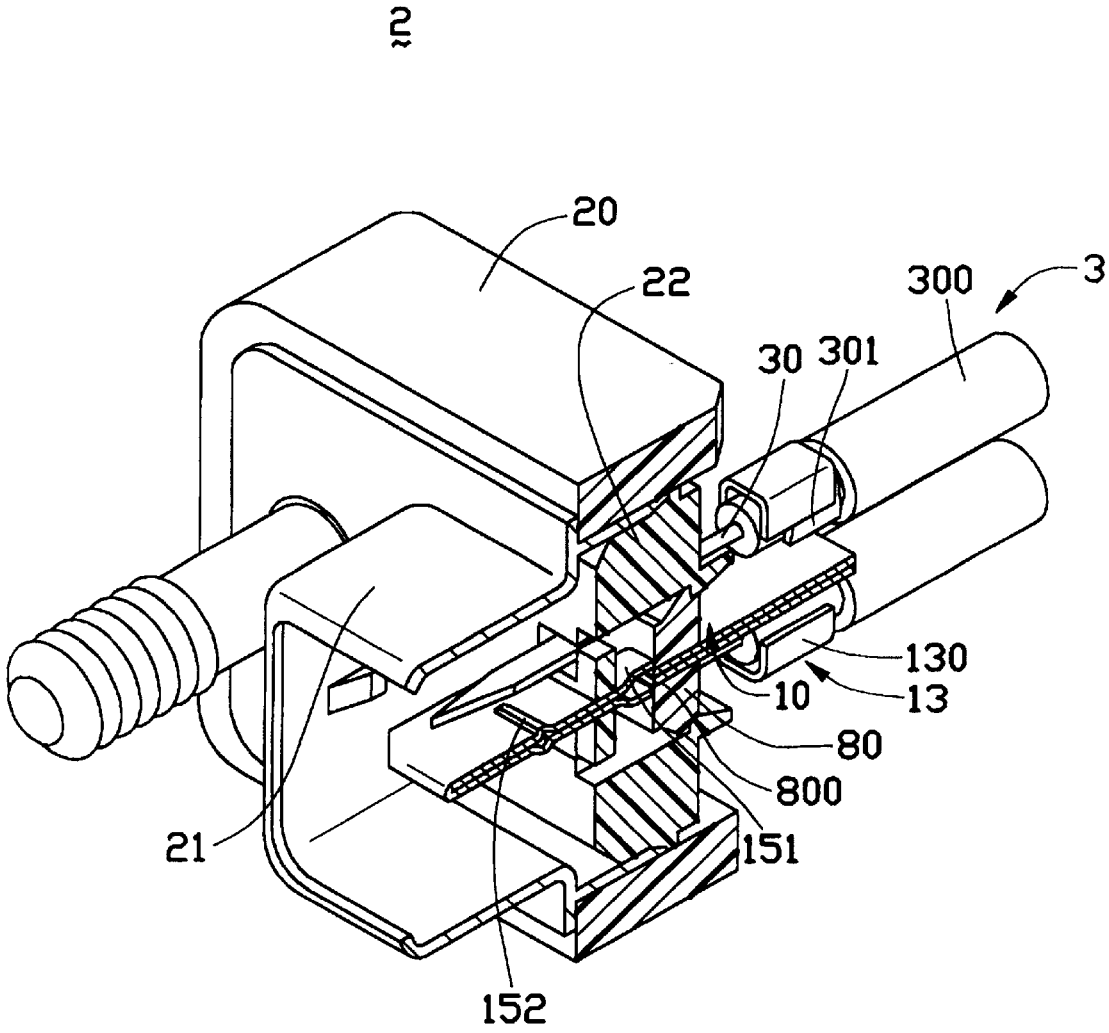
FIG. 1 is a perspective sectional view of a cable connector of the present invention having a grounding device.

Referring to FIG. 1, a cable connector 2 of the present invention comprises a dielectric cover shell 20, a conductive front shell 21 located on a front face of the cover shell 20, a dielectric housing 22 received within the cover shell 20 and a grounding device 1. The grounding device 1 comprises a grounding plate 10 arranged in a symmetrical dual-layer configuration and a terminal module 80 retained on the grounding plate 10. A slot 800 is defined in the terminal module 80 for clamping the grounding plate 10 therebetween.

Figure 2:
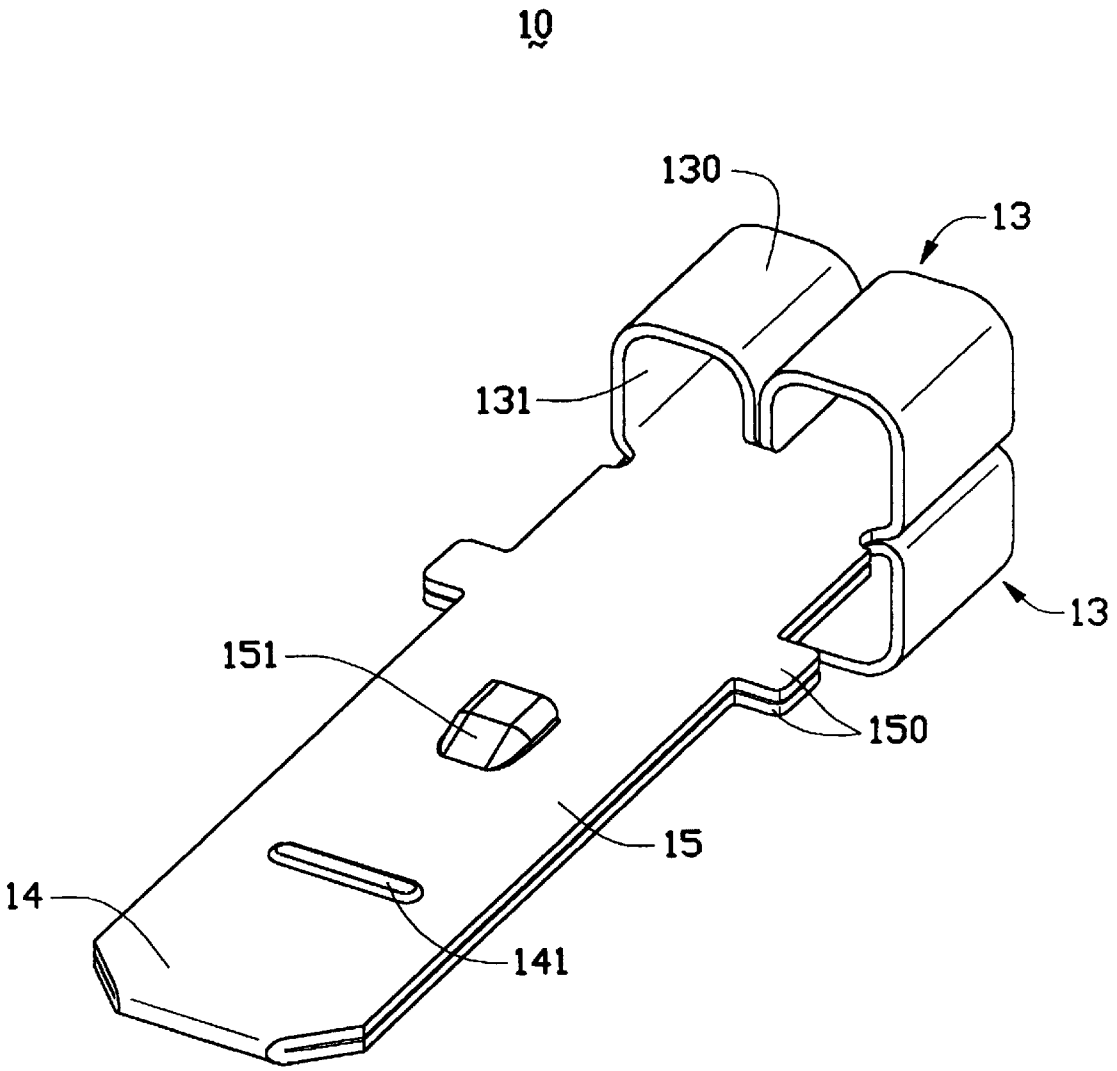
FIG. 2 is a perspective view of the grounding device of the cable connector of FIG. 1.
Figure 3:
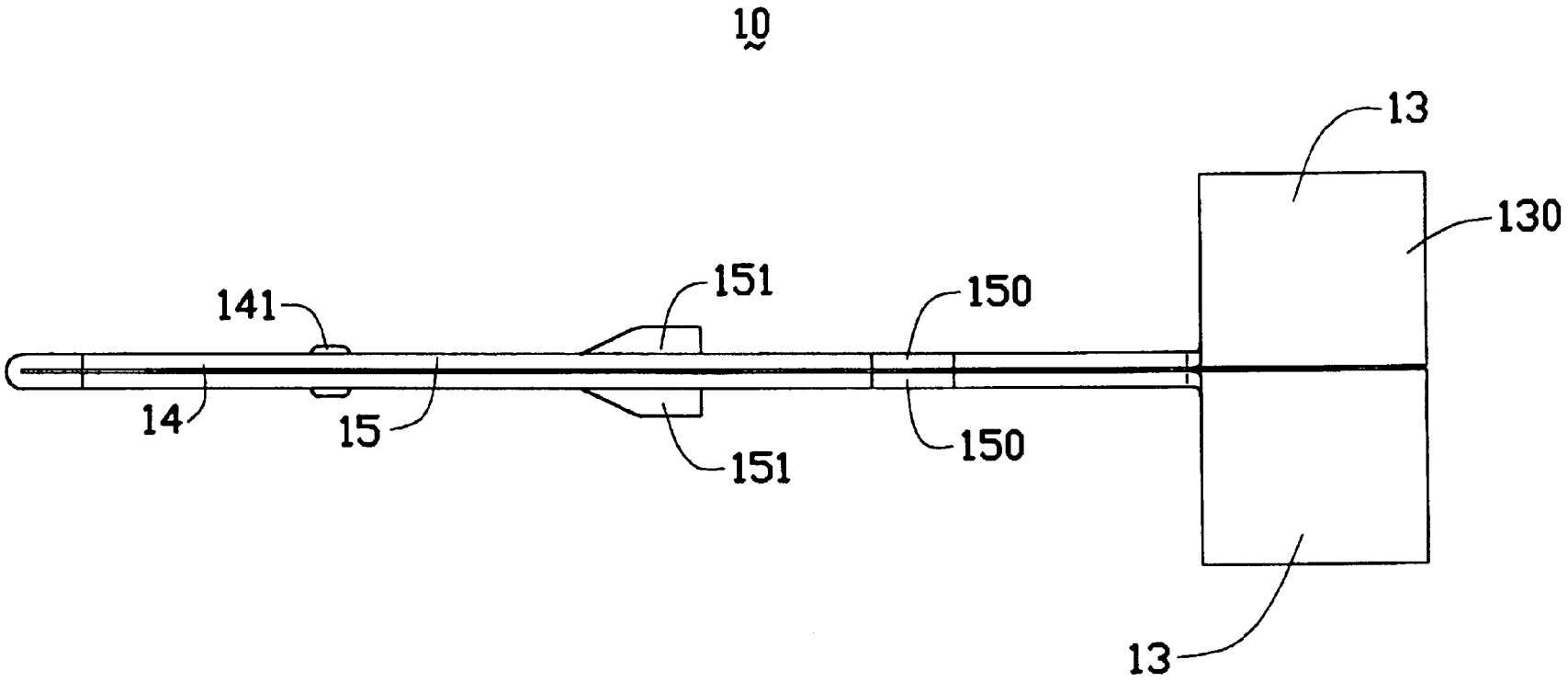
FIG. 3 is a side view of the grounding device of FIG. 2.
Figure 4:
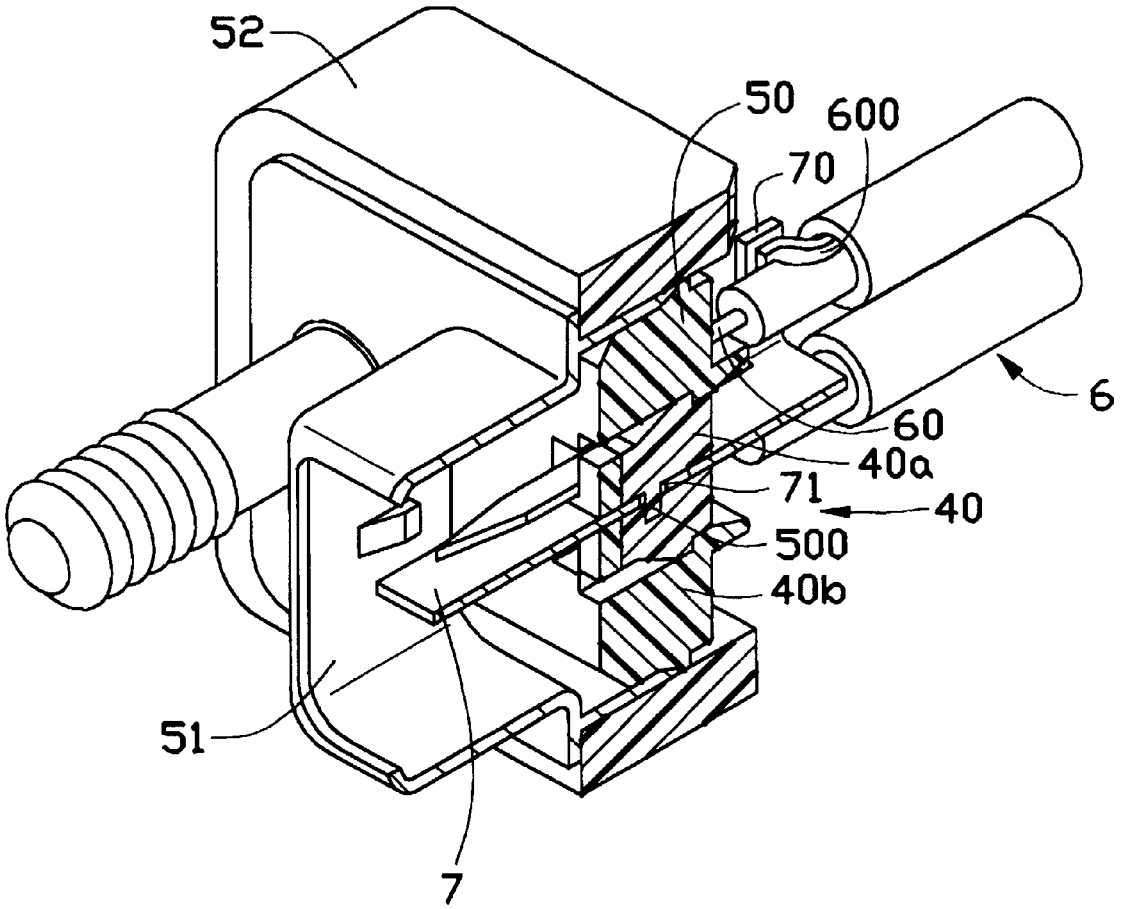
FIG. 4 (PRIOR ART)
FIG. 4 is a perspective view of a conventional cable connector.
Figure 5:
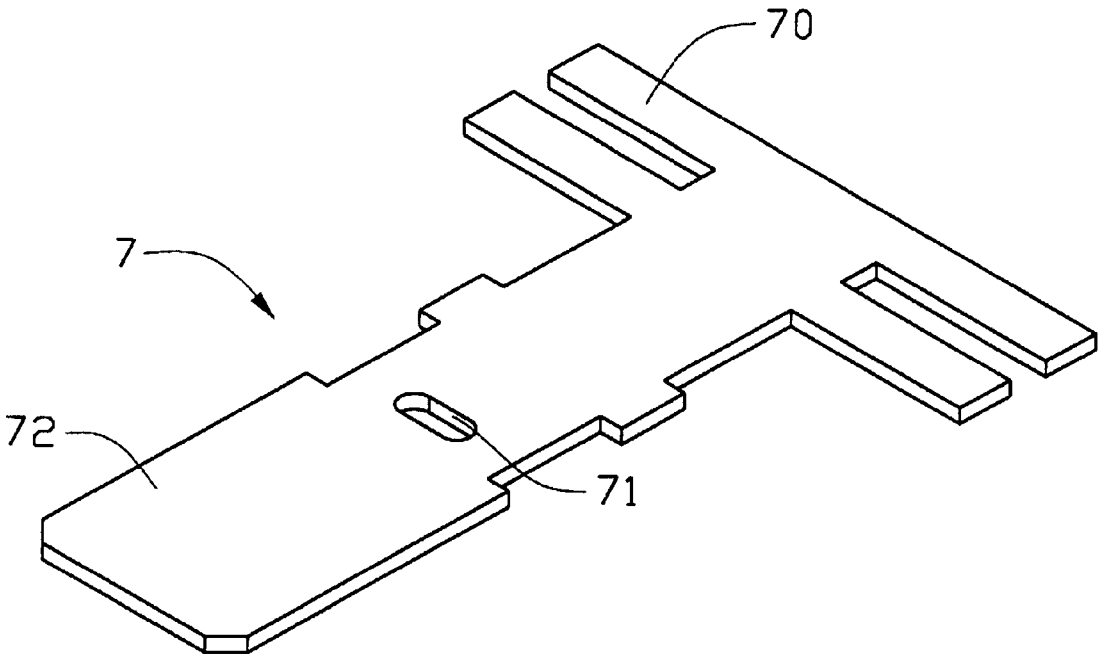
FIG. 5 (PRIOR ART)
FIG. 5 is a perspective view of a grounding blade of the conventional cable connector of FIG. 4.

Referring to FIG. 2, the grounding plate 10 includes a clamping portion 13 at a rear end thereof and a mating portion 14 at a front end thereof opposite the clamping portion, the mating portion 14 being adapted to engage with a mating connector (not shown). The grounding plate 10 is made from a piece of sheet metal symmetrically stamped and bended and folded double at the forward end of the mating portion 14. A locking portion 15 is defined in a middle of the grounding device proximate the mating portion 14. The clamping portion 13 includes clamping sections 130. The clamping sections 130 are bent to form receiving channels 131 for receiving cables 3. A plurality of tabs 150 project from opposite sides of the locking portion 15 proximate the clamping portion 13. Spring locking members 151 are outwardly stamped on opposite surfaces of the locking portion 15, the locking members 151 inclining outwardly and rearwardly. The grounding plate 10 securely engages with the terminal module 80 by means of the locking members 151 and the tabs 150. A bulge 141 is outwardly stamped on both surfaces of the mating portion 14.

In assembly, the conductive front shell 21 is disposed on the front face of the dielectric cover shell 20. The grounding plate 10 is extended through the slot 800 of the terminal module 80, thereby obtaining the grounding device 1. The cables 3 are connected to the grounding device 1, part of an insulative sheath 300 of each cable 3 being stripped off to expose a metal shield 301 disposed within each insulative sheath 300 and the metal shield 301 being firmly clamped within a receiving channel 131 of the clamping sections 130 of the grounding device 1. The locking members 151 and the tabs 150 of the locking portion 15 fit snugly against respective front and back sides of the terminal module 80 adjacent to the slot 800. The locking members 151 secure against a front wall of the terminal module 80, inclining outwardly and rearwardly, preventing the grounding plate 10 from being pulled out of the slot 800 after being extended into the slot 800. The terminal module 80 of the grounding device 1 is then inserted into a rear side of the insulative housing 22 of the cable connector 2. The insulative housing 22 is inserted into a rear side of the dielectric cover shell 20 and the conductive front shell 21, the mating portion 14 of the grounding device 1 being received in the front shell 21. When the cable connector 2 mates with a mating connector, the grounding device engages with a corresponding grounding receptacle in the mating connector. Compared with conventional grounding devices, the disposition of the bulge 141 thereon provides a relatively large interference force for securely engaging the grounding device and the corresponding device in the mating connector. Such a large interference force can be easily sensed by an operator, thereby providing a detection mechanism for assuring effective engagement between the cable connector and the mating connector. Moreover, the interference force provided by the bulge 141 effectively prevents unintentional disengagement of the mating connector.

As described in the above description, the cable connector of the present invention provides a mechanism to interferentially engage with a mating connector. When the cable connector mates with the mating connector, the user can easily sense that a secure engagement has been made.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

what is claimed is:

1. A grounding device for use in a cable connector, comprising:

a grounding plate arranged in a symmetrical dual-layer configuration with bight connection between two layers thereof around a front end of the grounding plate, wherein said dual-layer configuration is symmetrical with regard to the bight connection, each layer including:

a clamping portion being formed at a rear end thereof, the clamping portion defining a pair of clamping sections each adapted for retaining an exposed metallic shield of a cable, a locking portion being located in a middle of the grounding plate, and a mating portion being defined at the front end thereof opposite the clamping portion, the mating portion having a bulge protruded from a surface of said layer for indicating a positive engagement between the cable connector and a mating connector; and a terminal module being slid onto and retained to the locking portion of the grounding plate, the terminal module clamping the grounding plate to a dielectric housing of the cable connector.

2. The grounding device as claimed in claim 1, wherein a respective spring locking member is stamped on opposite outer surfaces of the locking portions, the locking members protruding outwardly and rearwardly to securely retain the terminal module to the grounding plate, a plurality of tabs projecting from opposite sides of the locking portion thereof proximate the clamping portion for securely retaining the terminal module to the grounding plate.

3. The grounding device of the cable connector as claimed in claim 2, wherein each clamping section is bent to define a receiving channel for receiving the exposed metallic shield of the cable.

4. A cable connector comprising:

an insulative housing with a terminal module therein;

a slot defined in the terminal module;

a grounding plate extending through said slot and arranged in a dual-layer configuration with bight connection between two layers thereof around a front end of the grounding plate, wherein said dual-layer configuration is symmetrical with regard to the bight connection;

each layer of said dual-layer configuration defining a mating portion at said front end and a clamping portion around a rear end thereof, said clamping portion defining a pair of clamping sections, each clamping section mechanically and electrically engaged with an exposed metallic shield of a cable, the clamping portions of both two layers being vertically aligned with each other; and each layer further including a locking portion being located in a middle of said grounding plate, said locking portion latchably engaged with the terminal module.

5. A cable connector comprising:

an insulative housing with a terminal module therein;

a slot defined in the terminal module;

a grounding plate extending through said slot and arranged in a dual-layer configuration with bight connection between two layers thereof around a front end of the grounding plate, wherein said dual-layer configuration is symmetrical with regard to the bight connection;

each layer including a clamping portion being formed at a rear end and a locking portion being located in a middle of the grounding plate thereof, the clamping portion defining a pair of clamping sections each adapted for retaining an exposed metallic shield of a cable; and said two layers commonly defining a pair of locking members on opposite surfaces of the grounding plate and extending in opposite vertical directions, and at least a pair of tabs extending in opposite horizontal lateral directions; wherein said pair of locking members and said pair of tabs respectively abut against front and back sides of the terminal module.

* * * * *